US006446415B1

(12) United States Patent
Tale' et al.

(10) Patent No.: US 6,446,415 B1
(45) Date of Patent: Sep. 10, 2002

(54) METHOD OF FORMING GROUPS OF CIGARETTES ON A CIGARETTE PACKING MACHINE

(75) Inventors: Fabrizio Tale', Bologna; Marco Brizzi, Zola Predosa; Mario Spatafora, Bologna, all of (IT)

(73) Assignee: G.D Societa Per Azioni, Bologna via Pomponia (IT)

( * ) Notice: Subject to any disclaimer, the term of this patent is extended or adjusted under 35 U.S.C. 154(b) by 0 days.

(21) Appl. No.: 09/475,340

(22) Filed: Dec. 30, 1999

(30) Foreign Application Priority Data

Jan. 15, 1999 (IT) ..... B099A0020

(51) Int. Cl.[7] ..... B65B 19/02
(52) U.S. Cl. ..... 53/444; 53/493; 53/494
(58) Field of Search ..... 53/148, 234, 444, 53/575, 149, 151, 493, 494

(56) References Cited

U.S. PATENT DOCUMENTS 4,306,648 A * 12/1981 Manservisi ..... 198/419
4,502,261 A * 3/1985 Zullo ..... 53/54
4,503,967 A * 3/1985 Erdmann et al. ..... 198/419
4,700,825 A * 10/1987 Mattei et al. ..... 198/419
5,472,078 A * 12/1995 Hoffmann ..... 198/431
5,617,943 A * 4/1997 Belvederi et al. ..... 198/418.1
5,718,102 A * 2/1998 Draghetti ..... 53/444

FOREIGN PATENT DOCUMENTS

| | | |
|---|---|---|
| EP | 0 764 582 A | 3/1997 |
| FR | 2 527 547 A | 12/1983 |
| GB | 2 151 595 A | 7/1985 |

* cited by examiner

*Primary Examiner*—Scott A. Smith
*Assistant Examiner*—Nathaniel Chukwurah
(74) *Attorney, Agent, or Firm*—Marshall, Gerstein & Borun

(57) ABSTRACT

On a packing machine for packing cigarettes, whereby a group of cigarettes is formed by withdrawing the cigarettes from one or more outlets of a hopper, interception, in response to a control signal, of the stream of cigarettes from any one outlet results in simultaneous interception of the respective streams from all of any other outlets participating, with the intercepted outlet, in the formation of the group, but not in simultaneous stoppage of the packing machine as a whole.

7 Claims, 5 Drawing Sheets

Fig.1
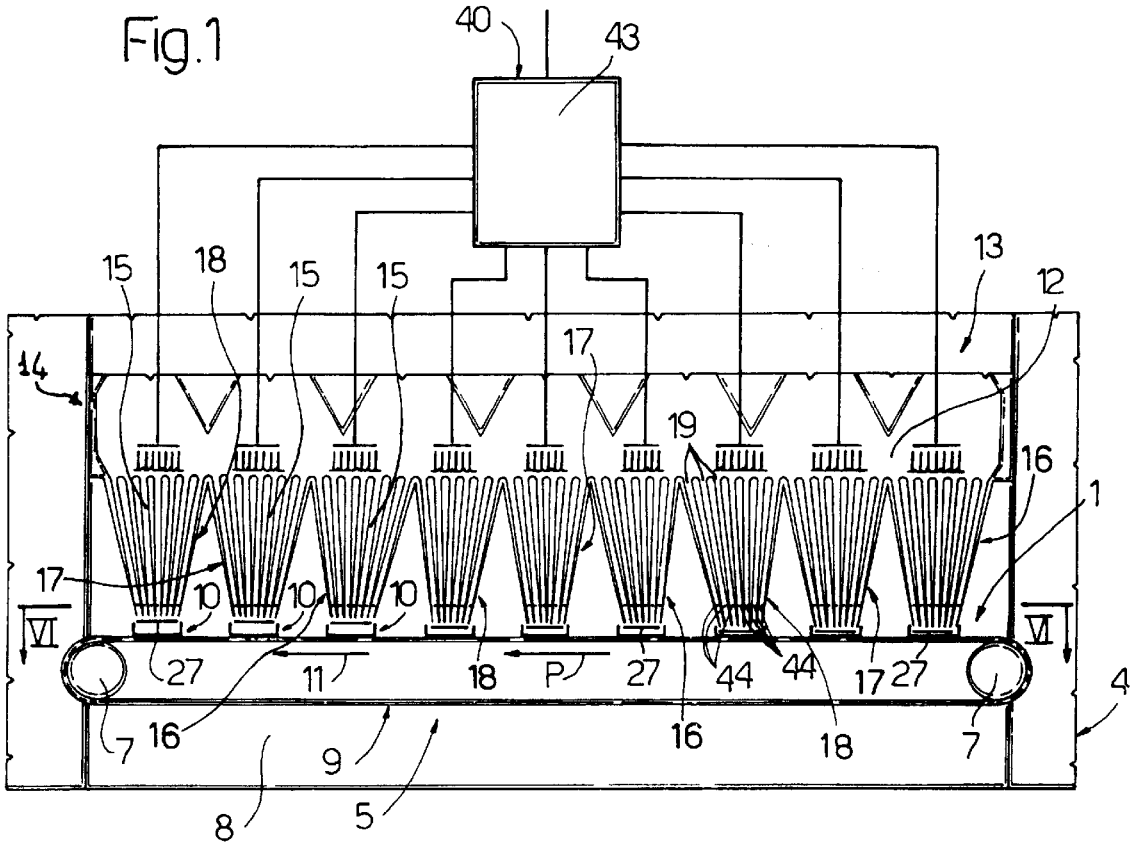
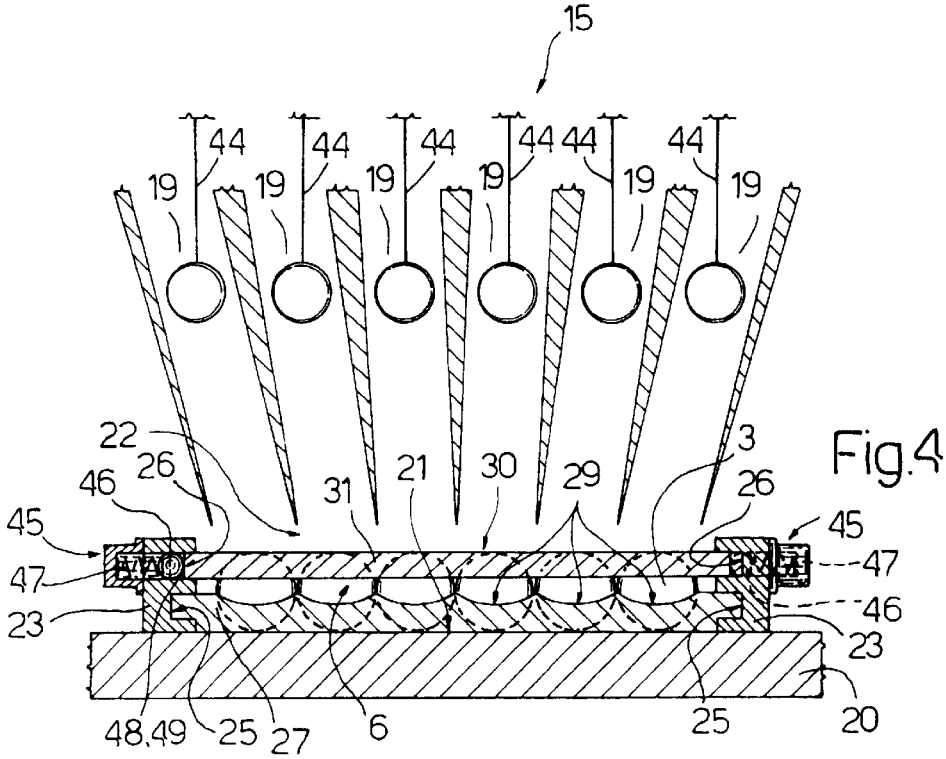
Fig.4

METHOD OF FORMING GROUPS OF CIGARETTES ON A CIGARETTE PACKING MACHINE

The present invention relates to a method of forming groups of cigarettes on a cigarette packing machine.

More specifically, the present invention relates to a method of forming groups of cigarettes on a cigarette packing machine capable of forming, substantially simultaneously, at least two groups of cigarettes, each forming the content of a packet of cigarettes.

BACKGROUND OF THE INVENTION

On cigarette packing machines, groups of cigarettes are fed, at least in pairs, to at least one packing line by a supply device, which is fed in steps in a substantially horizontal direction, and comprises a number of pockets equally spaced along one or a number of parallel supply lines, and each for housing a respective group of cigarettes.

The cigarettes are fed to the group supply device by a hopper having an output end divided into a number of outlets arranged in at least two groups, each for forming a respective group of cigarettes. When each group of cigarettes is formed by superimposing layers, each group of outlets is defined by a number of outlets at most equal to the number of layers in each group of cigarettes. Conversely, when each group of cigarettes is formed in one go, each group of outlets is defined by a single outlet.

Each outlet is divided into a number of substantially vertical channels equal in number to the cigarettes in the respective layer or, if the groups of cigarettes are formed in one go, to the cigarettes in the longest layer in the respective group of cigarettes.

When each group of cigarettes comprises three superimposed layers and is formed by superimposing the layers, and when the hopper comprises, for example, three groups of three outlets each, the supply device moves forward in steps to position, at each stop, nine pockets beneath the output end of the hopper and aligned with the nine outlets. In this case, the output end of the hopper has nine push members, which are activated simultaneously to transfer, at each stop of the supply device, a layer of cigarettes into each of the nine pockets facing the respective push members.

The push members are so arranged that each of three first push members feeds a respective bottom layer into each of the three facing pockets; each of three second push members feeds a respective intermediate layer into each of the three facing pockets; and each of three third push members feeds a respective top layer into each of the three facing pockets. Since a complete group of cigarettes is formed inside a respective pocket in the course of three successive steps of the supply device, each pocket is therefore positioned, in the course of said steps, at the three outlets defining the same group of outlets.

When each group of cigarettes comprises two or more superimposed layers and is formed in one go at a respective outlet, and when the hopper comprises at least two outlets, which may be located over the same cigarette group conveyor line or over respective parallel lines, the supply device moves forward in steps to position, at each stop, two pockets beneath the output end of the hopper and aligned with the two outlets. In this case, the output end of the hopper has two push members, which are activated to transfer, at each stop of the supply device, a group of cigarettes into each of the two facing pockets.

A major drawback of both the above known forming devices lies in incomplete groups of cigarettes issuing from the hopper—and which must therefore be rejected—whenever the flow of cigarettes along even only one channel of any one of the outlets is cut off by the presence, for example, of a cigarette positioned crosswise over the inlet of the channel.

To eliminate the above drawback, known forming devices of the above type normally comprise a stop signal emitter, which provides for total stoppage of the packing machine in response to a signal indicating no flow of cigarettes along even only one of the supply channels.

SUMMARY OF THE INVENTION

It is an object of the present invention to provide a method of forming groups of cigarettes, designed to eliminate the aforementioned drawbacks.

In particular, it is an object of the present invention to provide a method of forming groups of cigarettes, whereby stoppage of the outflow of cigarettes from an outlet of the hopper does not result in the formation of incomplete groups of cigarettes, let alone in total stoppage of the packing machine.

It is a further object of the present invention to provide a method of forming groups of cigarettes, which provides, if necessary, for reducing the output of a cigarette packing machine implementing the method.

According to the present invention, there is provided a method of forming groups of cigarettes on a cigarette packing machine; the packing machine comprising a hopper for supplying cigarettes; the hopper comprising at least two groups of outlets; each group of outlets comprising a number of outlets ranging between one and a number equal to the number of layers of cigarettes in each group of cigarettes; and the outlets in each group of outlets participating in forming a respective said group of cigarettes; the method being characterized by comprising the step of simultaneously intercepting respective streams of cigarettes issuing from all the outlets in a said group of outlets in response to a control signal.

BRIEF DESCRIPTION OF THE DRAWINGS

Two non-limiting embodiments of the invention will be described by way of example with reference to the accompanying drawings, in which:

FIG. 1 shows a schematic front view, with parts removed for clarity, of a preferred embodiment of the forming device according to the present invention;

FIG. 4 shows a section, with parts removed for clarity, along line IV—IV in FIG. 2;

DETAILED DESCRIPTION OF THE INVENTION

Figures 2, 3:
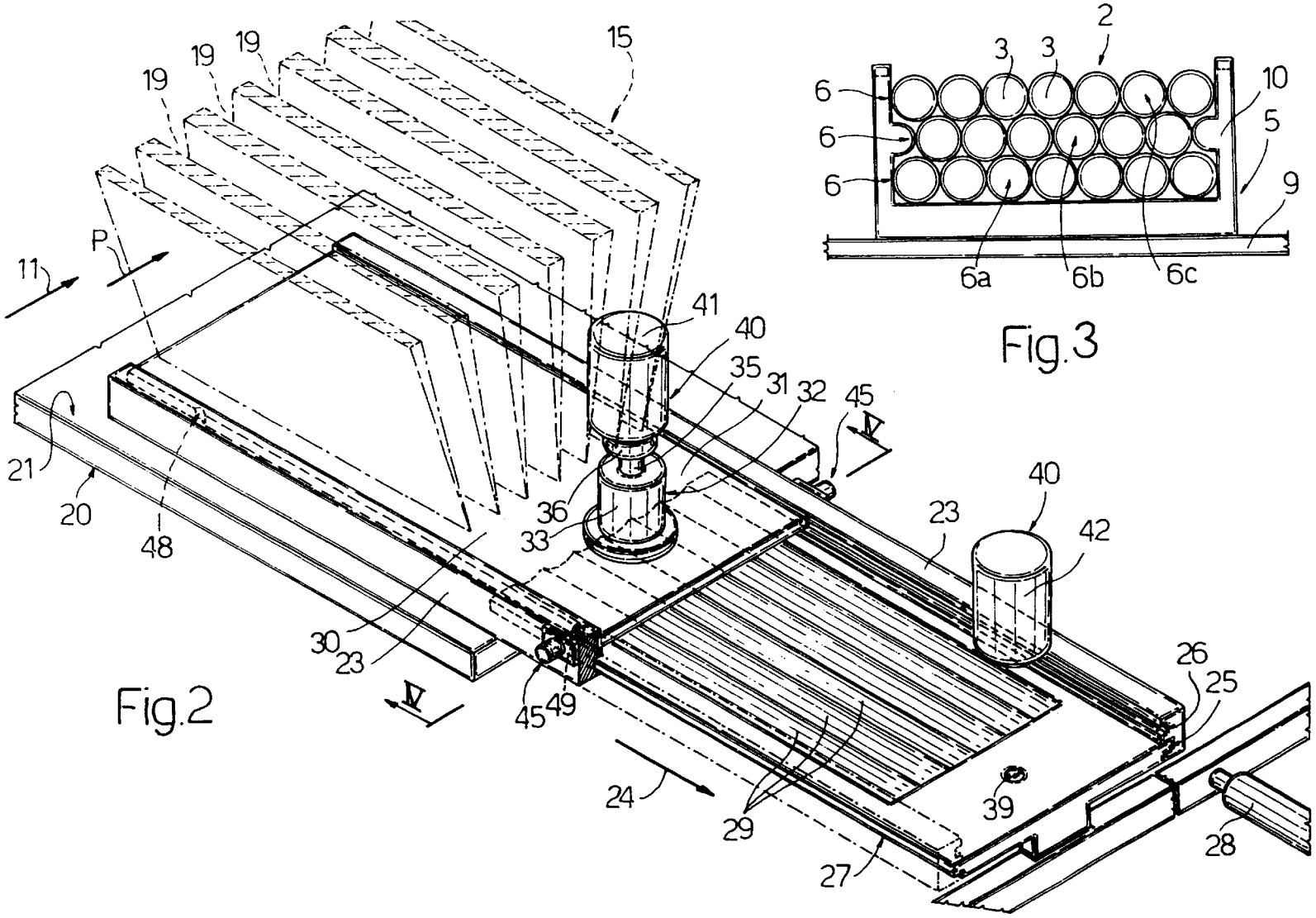
FIG. 2 shows a larger-scale, partially sectioned view in perspective of a detail in FIG. 1.
FIG. 3 shows a larger-scale view of a further detail in FIG. 1.

Number 1 in FIG. 1 indicates as a whole a device for simultaneously forming at least two groups 2 (FIG. 3) of cigarettes 3 (in the example shown, three groups 2 of cigarettes 3) on a cigarette packing machine 4.

Forming device 1 comprises a supply device 5 for feeding a succession of groups 2 to a packing line (not shown) of packing machine 4. Each group 2 forms the content of a packet (not shown) of cigarettes, and is defined by at least one layer of cigarettes, and preferably by a number of superimposed layers of cigarettes 3. In particular, in the FIG. 3 embodiment, each group 2 comprises three superimposed layers 6 indicated 6*a*, 6*b* and 6*c*.

Supply device 5 comprises two pulleys 7—one of which is powered—fitted to a fixed frame 8 so as to rotate in steps about respective axes parallel to each other and perpendicular to the FIG. 1 plane. In the example embodiment shown, device 5 also comprises a single conveyor belt 9 looped about pulleys 7 and having a number of pockets 10 equally spaced along belt 9 and each for receiving a respective group 2. Pulleys 7 are rotated anticlockwise, and the pockets 10 along a substantially horizontal top conveying branch of belt 9 are fed in a direction 11 and along a substantially horizontal supply path P.

In variations not shown, pulleys 7 support a number of belts 9 parallel with one another and each having a respective succession of pockets 10.

Forming device 1 also comprises a hopper 12 located over, and set back with respect to, device 5, and which forms the end portion of a unit 13 for supplying cigarettes 3. Hopper 12 comprises an output end 14 having nine outlets 15 divided into three groups indicated 16, 17, 18, and each group is defined by the three outlets 15 responsible for forming the same group 2 of cigarettes 3. Outlets 15 may be arranged with any spacing over belt 9, and belt 9 itself operated in steps of any length, providing, as in the example shown, each outlet 15 faces a respective pocket 10 at each stop of belt 9, and, at each stop, each pocket 10 is positioned beneath a different outlet 15 of the relative group 16, 17, 18 until group 2 is completed.

In the FIG. 1 embodiment, outlets 15 are so arranged along path P that, at each stop of belt 9, each of the first three outlets 15 feeds a bottom layer 6*a* of cigarettes 3 into a respective pocket 10; and, at the same time, each of the second three outlets 15 feeds an intermediate layer 6*b* of cigarettes 3 into a respective pocket 10, and each of the third three outlets 15 feeds a top layer 6*c* of cigarettes 3 into a respective pocket 10.

In alternative embodiments not shown, hopper 12 comprises a number of outlets 15 equal to any further multiple of three, and the three outlets 15 defining the same group 16–18 are arranged along path P in a different order from that shown in FIG. 1, e.g. are adjacent to one another. It should also be pointed out that, depending on the number of layers 6 in each group 2 of cigarettes 3, the outlets 15 of hopper 12 are divided into groups of outlets 15, each comprising a number of outlets 15 equal to the number of layers 6 in the relative group 2 of cigarettes 3.

Each outlet 15 is divided by substantially vertical partitions into a number of channels 19 equal in number to the cigarettes 3 in relative layer 6, and along which cigarettes 3 travel in a direction substantially crosswise to direction 11 and to the respective longitudinal axes of cigarettes 3.

With reference to FIGS. 2 and 4, hopper 12 comprises three fixed horizontal plates 20 located beneath hopper 12 to support the cigarettes 3 traveling along channels 19 of the first three outlets 15, of the second three outlets 15, and of the third three outlets 15 respectively. The respective top surfaces 21 of plates 20 are located at increasing levels differing from one another by an amount substantially equal to the diameter of a cigarette 3, and, together with respective outlets 15, define respective horizontal gaps 22 of a height approximately equal to but no less than the diameter of a cigarette 3 (FIG. 4). It should be pointed out that surface 21 of plate 20 relative to the first three outlets 15 is coplanar with the bottom wall of each pocket 10.

Each outlet 15 has two parallel guides 23, which are located on opposite sides of outlet 15 in direction 11, extend parallel to a horizontal direction 24 crosswise to direction 11, are connected integrally to relative plate 20, and project from the opposite edge of plate 20 to that facing belt 9. Each guide 23 has a bottom longitudinal groove 25 and a top longitudinal groove 26, which extend parallel to direction 24 and are formed along the edge of guide 23 facing the other guide 23.

The two grooves 25 house in sliding manner a push member 27, which is defined by a substantially rectangular plate—two opposite longitudinal edges of which are engaged in sliding manner inside respective grooves 25—and is moved by an actuating cylinder 28 normally common to all of push members 27, which are therefore moved simultaneously between a rest position (FIGS. 5*b* and 5*d*) in which push member 27 is located substantially outside relative gap 22, and a work position (FIGS. 5*a* and 5*c*) in which push member 27 is located inside relative gap 22. The top surface of member 27 has a number of grooves 29 equal in number to the channels 19 of respective outlet 15 and parallel to direction 24. When member 27 is in the work position, each groove 29 is positioned facing the outlet of a respective channel 19 to receive a respective cigarette 3.

The two grooves 26 of guides 23 of each outlet 15 house in sliding manner an intercepting member 30 comprising a substantially rectangular plate 31, the opposite longitudinal edges of which engage in sliding manner respective grooves 26. Member 30 also comprises a connecting device 32 for connecting plate 31 and member 27 to each other so as to move plate 31, together with member 27, between a rest position (FIGS. 5*a* and 5*b*) in which plate 31 is substantially outside relative gap 22, and a work position (FIGS. 5*c* and 5*d*) in which plate 31 engages relative gap 22.

As shown in FIG. 4, the total height of member 27 and plate 31 is approximately equal to but no greater than the diameter of a cigarette 3, and is therefore less than the height of relative gap 22.

As shown in FIG. 5, connecting device 32 comprises a tubular guide body 33 extending upwards from plate 31 and coaxial with a through hole 34 formed through plate 31. Connecting device 32 also comprises a pin 35, a head 36 of which normally cooperates, by means of a spring 37, with a top free surface of tubular body 33, and an end portion 38 of which, at the opposite end to head 36, projects from the bottom of plate 31 to engage a through hole 39 in member 27 when head 36 is positioned contacting the top end of tubular body 33. Pin 35 is moved in opposition to respective spring 37 by an actuating unit 40 comprising two electromagnets 41 and 42, which are coaxial with pin 35 and face head 36 when plate 31 is in the work position and rest position respectively. Electromagnets 41 and 42 are energized selectively by a central control unit 43, which is normally common to all of intercepting members 30 and operates in response to a signal supplied to central control unit 43 by any one of control devices 44, each relative to a respective channel 19 of outlet 15.

Each plate 31 is provided with a ball lock device 45 for preventing accidental translation of plate 31 in direction 24 when plate 31 is in the work or rest position. Device 45 comprises two balls 46, each of which—by means of a respective spring 47 parallel to direction 11 and supported by respective guide 23, and when plate 31 is in the rest or work position—selectively engages two respective cavities 48 and 49 formed along a respective longitudinal edge of plate 31.

Operation of forming device 1 will be described with reference to FIG. 5.

Figures 5A, 5B, 5C, 5D:
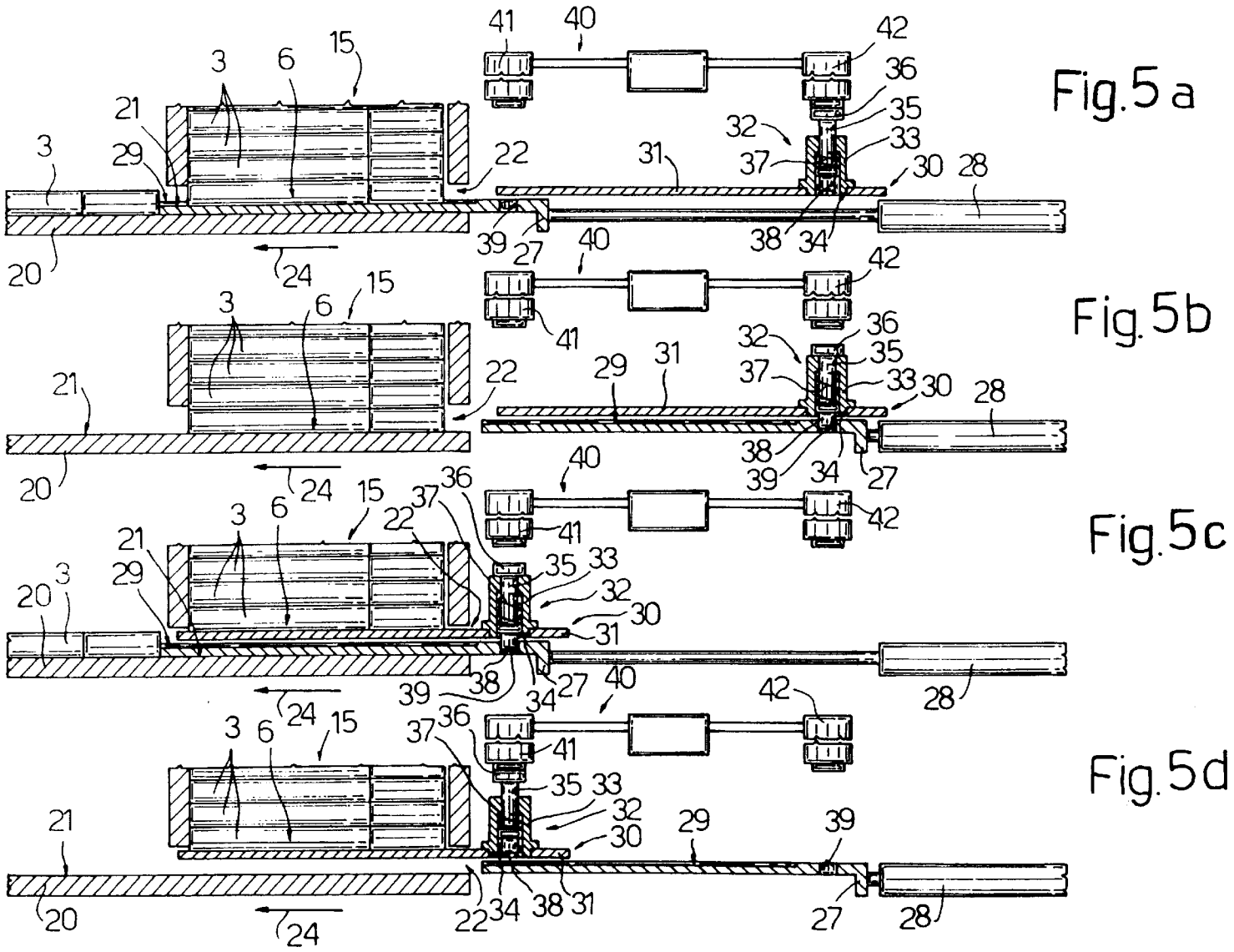
FIG. 5 shows the FIG. 2 detail in successive operating positions.
Figure 6:
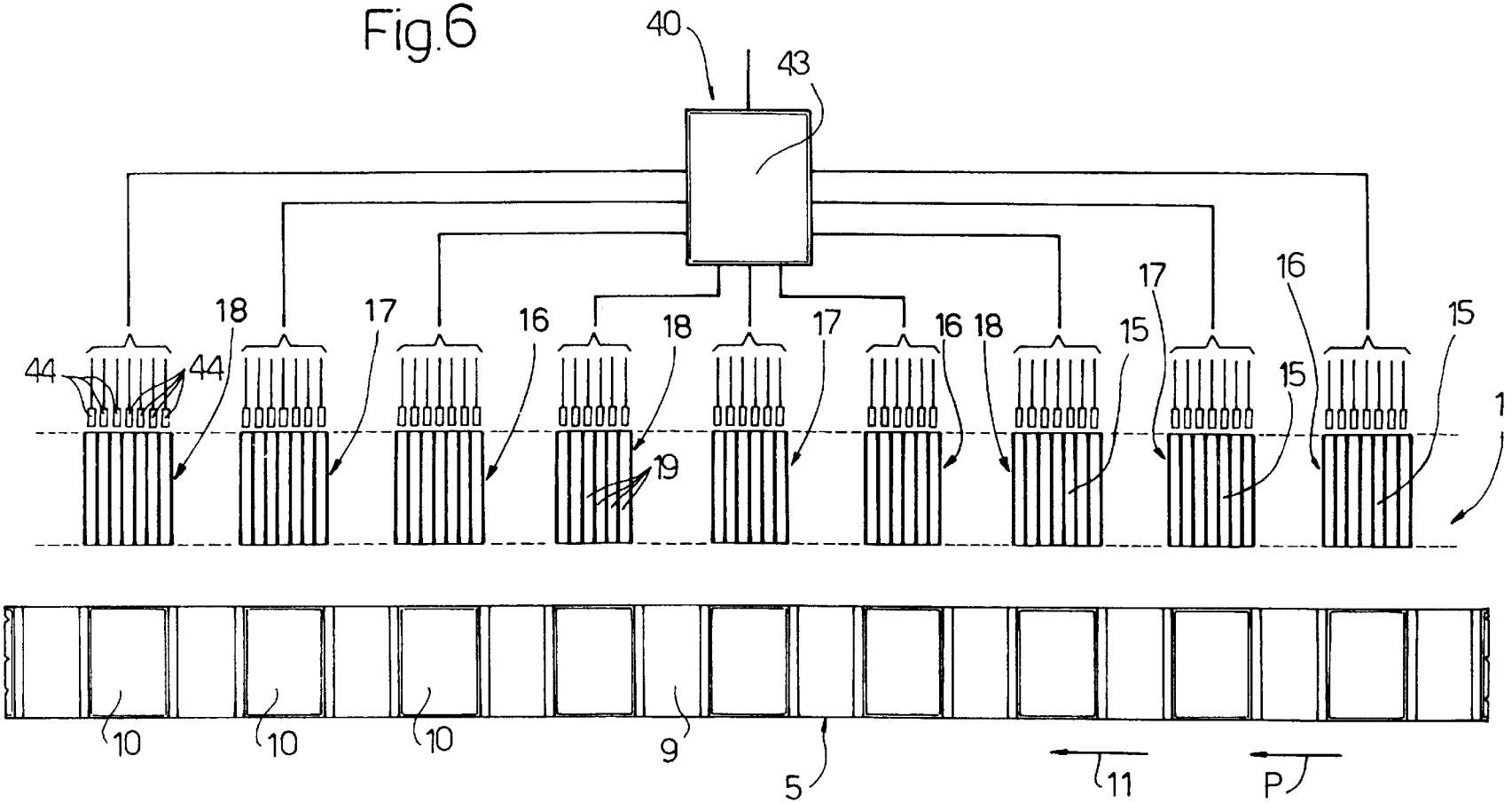
FIG. 6 shows a section along line VI—VI in FIG. 1.

In FIG. 5*a*, forming device 1 is shown in the steady operating condition, in which intercepting members 30 are set to the rest position and disconnected from respective push members 27; each electromagnet 42 is energized by central control unit 43 to keep respective pin 35 raised in opposition to respective spring 37 and therefore withdrawn from hole 39 in respective push member 27, which, at each step of belt 9, transfers a respective layer 6 of cigarettes 3 into the facing pocket 10 without drawing along respective intercepting member 30, which is kept in the rest position by respective balls 46 engaging respective cavities 48.

In the steady operating condition, each step of supply device 5 corresponds to the formation of three complete groups 2 of cigarettes 3, which each comprise three superimposed layers 6 and are housed inside the three pockets 10 issuing, at each step, from beneath hopper 12. As a complete group 2 of cigarettes 3 is formed inside respective pocket 10 in the course of three successive steps of supply device 5, each pocket 10, in the course of said steps, is therefore positioned at three respective outlets 15 forming the same group 16–18 of outlets 15. Upon control device 44 of any one of channels 19 of an outlet 15 supplying central control unit 43 with a signal indicating clogging of, or a shortage of cigarettes 3 in, channel 19, central control unit 43 simultaneously activates the intercepting members 30 of the outlet 15 comprising the malfunctioning channel 19 and of all the outlets 15 forming part of the same group 16–18 as the intercepted outlet 15, thus preventing the formation of incomplete groups 2 of cigarettes 3 which would have to be rejected, and also enabling servicing of the malfunctioning channel 19 without interrupting operation of forming device 1.

The way in which intercepting members 30 of the three outlets 15 in each group 16–18 of outlets 15 are moved from the rest to the work position will now be described with reference to FIGS. 5*b*–5*d*.

With reference to FIG. 5*b*, central control unit 43 deactivates electromagnets 42 so that respective pins 35, by means of respective springs 37, engage respective holes 39 in respective push members 27; at which point (FIG. 5*c*), the intercepting members 30 of the three outlets 15 in question are moved simultaneously by actuating cylinder 28, and together with respective push members 27, into the work position. As each intercepting member 30 reaches the work position (FIG. 5*c*), balls 46 of respective lock device 45 engage cavities 49 in respective plate 31, and central control unit 43 energizes respective electromagnet 41 to release respective pin 35 from respective hole 39 (FIG. 5*d*), so that, whereas the three intercepting members 30 remain in the work position cutting off supply of respective cigarettes 3 to the three outlets 15 in question, the three associated push members 27 are released from respective intercepting members 30 to allow group operation of push members 27, which, at each operating cycle, are all moved simultaneously by cylinder 28 between the respective rest and work positions.

Forming device 1 also operates as described above in response to an external signal supplied to central control unit 43 to indicate, for example, malfunctioning of the packing line (not shown) downstream from forming device 1; in which case, considerable advantage is to be gained by operating forming device 1 at reduced capacity, i.e. with only six or three outlets 15. Depending on the signal received, central control unit 43 therefore provides for simultaneously closing the outlets 15 of one or two groups 16–18 of outlets 15.

When the outlets 15 of one or more groups 16–18 are intercepted, supply of the packing material for all the unformed groups 2 of cigarettes 3 not supplied to the packing line (not shown) is obviously also cut off.

Figure 7:
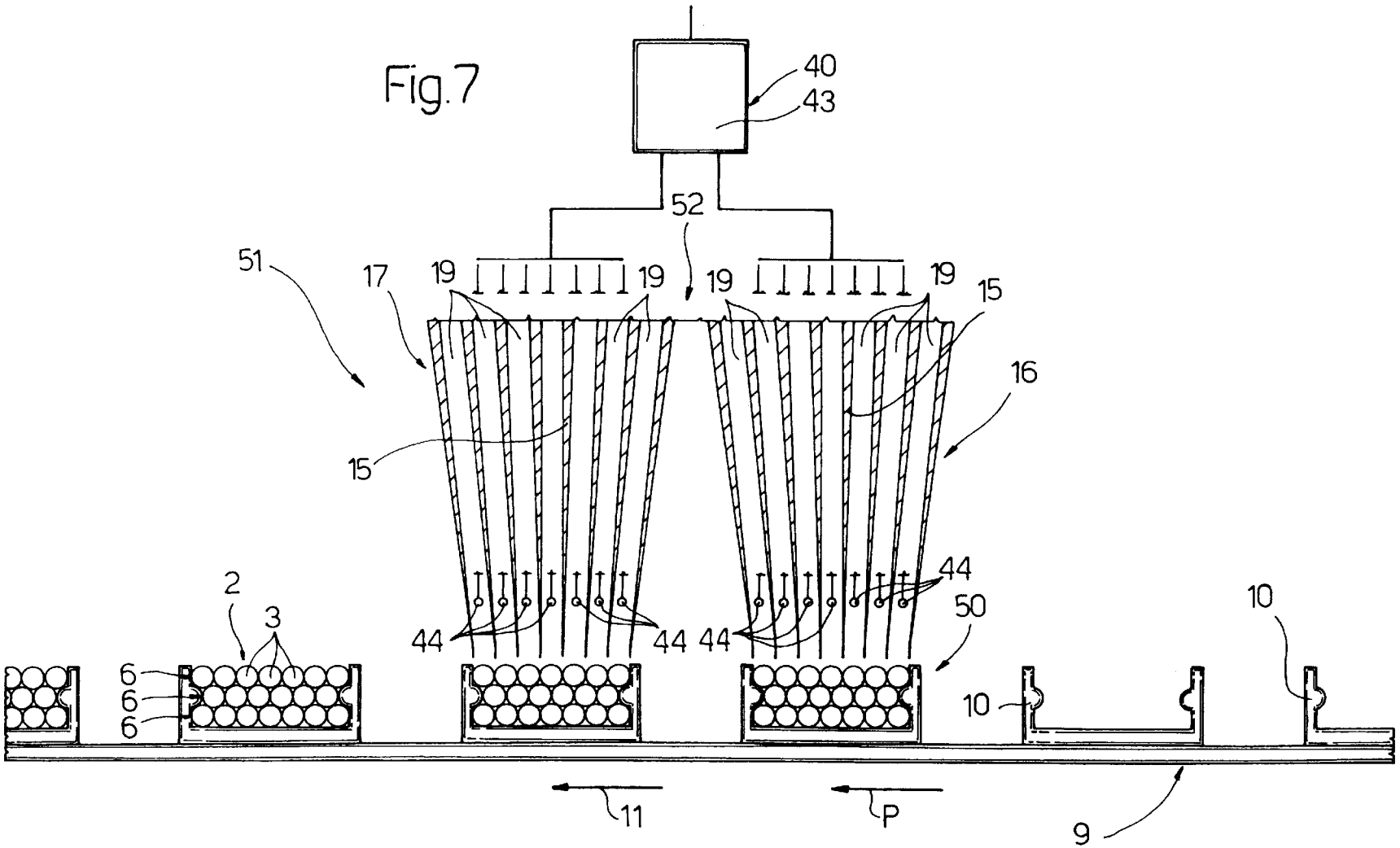
FIG. 7 shows the same view as in FIG. 1 of a further embodiment of the forming device according to the present invention.

The FIG. 7 variation shows a forming device 50 for forming groups 2 of cigarettes 3, and which forms part of a packing machine 51 for forming groups 2 of cigarettes 3 comprising three superimposed layers 6. In the case of forming device 50, each group 2 of cigarettes 3 is formed in one go at a respective outlet 15 of a hopper 52 which, in this case, comprises two groups 16, 17 of outlets 15, which groups are both located over the same line for conveying groups 2 of cigarettes 3, and are each defined by one outlet 15.

In the steady operating condition, each step of supply device 5 corresponds to the formation of two complete groups 2 of cigarettes 3 housed inside the two pockets 10 issuing, at each step, from beneath hopper 12. Upon control device 44 of any one of channels 19 of an outlet 15 supplying central control unit 43 with a signal indicating clogging of, or a shortage of cigarettes 3 in, channel 19, central control unit 43 activates the intercepting member 30 of the outlet 15 comprising the malfunctioning channel 19, thus enabling servicing of the malfunctioning channel 19 without interrupting operation of packing machine 51 as a whole.

As on packing machine 4, emission of a stop signal by central control unit 43 to close one or more outlets 15 may be operator-controlled to reduce the output of packing machine 51.

In alternative embodiments not shown, outlets 15 may obviously be more than two in number, and may be arranged over a number of parallel lines for conveying groups 2 of cigarettes 3.

What is claimed is:

1. A method of forming groups of cigarettes on a cigarette packing machine; the packing machine (4) comprising a hopper (12) for supplying cigarettes (3); the hopper (12) comprising at least two groups (16, 17, 18) of outlets (15); each group (16; 17; 18) of outlets (15) comprising a number of outlets (15) ranging between one and a number equal to the number of layers (6) of cigarettes in each group (2) of cigarettes (3); and the outlets (15) in each group (16; 17; 18) of outlets (15) participating in forming a respective said group (2) of cigarettes (3); the method comprising the step of simultaneously intercepting respective streams of cigarettes (3) issuing from all the outlets (15) in a said group (16; 17; 18) of outlets (15) in response to a control signal; each of said streams of cigarettes (3) being intercepted by means of a respective intercepting member (30), which is moved to and from a work position, in which the intercepting member (30) stops the respective stream of cigarettes (5) and is located beneath the respective said outlet (15).

2. A method as claimed in claim 1, wherein said control signal is a signal indicating malfunctioning of one of said outlets (15).

3. A method as claimed in claim 1, wherein said control signal is an external signal to reduce the number of working outlets (15).

4. A method as claimed in claim 1, and further comprising moving said intercepting member (30) between said work position and a rest position, in which the intercepting member (30) is located to the side of the respective outlet (15), by connecting the intercepting member (30) to a respective push member (27) movable back and forth beneath the respective said outlet (15) to extract the cigarettes (3) from the outlet (15).

5. A method as claimed in claim 4, wherein said intercepting member (30) is connected to the associated push member (27), together with all the intercepting members (30) of any outlets (15) participating in the formation of the same said group (2) of cigarettes (3), by means of a connecting device (32) movable selectively to and from a connecting position connecting said intercepting member (30) and the associated push member (27); the intercepting member (30) being moveable when connected to the push member (27).

6. A method as claimed in claim 5, wherein each said connecting device (32) is selectively activated by respective actuating means (41, 42) located at said work position and said rest position respectively; the connecting device (32) being activated in response of said control signal.

7. A method as claimed in claim 1, wherein each said group (2) of cigarettes (3) comprises at least two adjacent layers (6).

* * * * *